US006402336B1

(12) United States Patent
Reese

(10) Patent No.: US 6,402,336 B1
(45) Date of Patent: Jun. 11, 2002

(54) LIGHTS IN A BLANKET

(76) Inventor: Donald Reese, 9059 Hurricane Rd., Bay Minette, AL (US) 36705

( * ) Notice: Subject to any disclaimer, the term of this patent is extended or adjusted under 35 U.S.C. 154(b) by 0 days.

(21) Appl. No.: 09/654,241

(22) Filed: Sep. 2, 2000

(51) Int. Cl.[7] ..... F21V 21/14

(52) U.S. Cl. ..... 362/103; 362/234; 362/812; 362/806; 362/251

(58) Field of Search ..... 362/103, 108, 362/151, 252, 251, 806, 840; 40/541

(56) References Cited

U.S. PATENT DOCUMENTS 4,602,191 A * 7/1986 Davila ..... 362/76
4,709,307 A * 11/1987 Branom ..... 362/103
5,366,780 A * 11/1994 Rapisarda ..... 428/102
5,371,657 A * 12/1994 Wiscombe ..... 362/103
5,477,437 A * 12/1995 Lach ..... 362/252
5,519,595 A * 5/1996 Wang ..... 362/234
5,531,601 A * 7/1996 Amoroso ..... 439/37
5,624,181 A * 4/1997 Miller ..... 362/252
5,649,755 A * 7/1997 Rapisarda ..... 362/555
5,649,758 A * 7/1997 Dion ..... 362/103

* cited by examiner

*Primary Examiner*—Sandra O'Shea
*Assistant Examiner*—Hargobind S. Sawhney
(74) *Attorney, Agent, or Firm*—Michael I. Kroll

(57) ABSTRACT

The present invention 10 discloses a means for decorating using lights 30 which are fixed to a blanket 14. The blanket 14 can be of variable length and width constructed of a backing material 38 providing means for attaching a decorative symbol 40, as well as means for permanently attaching a light string 30 thereto. The light string 30 can form a random pattern, or a recognizable symbol 16 and can be used to highlight some decorative design within the blanket 14 itself. The blanket 14 can be attached to any appropriate surface 26 using fastening means 32. Further the blanket can be rolled up for storage purpose which eliminates the lights 30 and wires 52 becoming entangled.

13 Claims, 11 Drawing Sheets

LIGHTS IN A BLANKET

BACKGROUND OF THE INVENTION

1. Field of the Invention

The present invention relates generally to decorative lights and, more specifically, to a means for decorating using lights which are fixed to a blanket. Said blanket can be of variable length and width constructed of a backing material providing means for attaching a decorative symbol, as well as means for permanently attaching a light string thereto. The light string can form a random pattern, or a recognizable symbol and can be used to highlight some decorative design within the blanket itself. The blanket can be attached to any appropriate surface using fastening means. Further said blanket can be rolled up for storage purpose which eliminates the lights and wires becoming entangled.

2. Description of the Prior Art

There are decorative lights having the conductive member affixed to a substrate material. Typical of these is U.S. Pat. No. 5,649,7588 issued to Larry Dion on Jul. 22, 1997.

Another patent was issued to Rapisarda on Jul. 22, 1997 as U.S. Pat. No. 5,649,755. Yet another U.S. Pat. No. 5,624,181 was issued to Miller et al. on Apr. 29, 1997 and still yet another was issued on Jul. 2, 1996 to Amoroso as U.S. Pat. No. 5,531,601. Another patent was issued on Wiscombe on Dec. 6, 19944 as U.S. Pat. No. 5,371,657 and still yet another was issued on Nov. 22, 1994 to Rapisarda as U.S. Pat. No. 5,366,780.

U.S. Pat. No. 5,649,758

Inventor: Larry Dion

Issued: Jul. 22, 1997

An article of apparel which includes at least one LED which is intermittently and repetitively turned on. In one forma hollow ball or shell contains an LED and a digital pulser comprising a battery and a digital oscillator for passing successive pulses of current through the LED. Preferably the shell is made in two separable and halves, to permit easy access to the interior to turn it on or off manually, to repair it, or to replace the battery. In another form, the invention comprises a linear series of LED's on a strip which can be fastened between the laces and tongue of a shoe, the LED's being successively turned on momentarily to produce the apperance of light moving along the strip.

U.S. Pat. No. 5,649,755

Inventor: Carmen C. Rapisarda

Issued: Jul. 22, 1997

An elongated, decorative, flexible light-transmitting assembly particularly useful for adorning wearing apparel. The assembly includes a source of light having a light transmitting area. A length of clear flexible polymer has a first end adjacent the light-transmitting area and an elongated body having an outer surface and a remote end. The length has many marks formed inwardly from the outer surface to cause the light entering the first end to be reflected in an attractive manner.

U.S. Pat. No. 5,624,181

Inventor: Kenneth C. Miller et al

Issued: Apr. 29, 1997

A lighted display features a decorative mounting board having an outer display surface and a rear surface. A string of lights has a plurality of bulb sockets which mount bulbs in their openings and are interconnected by electrical wiring. The bulb lighting portions each have a diameter smaller than the diameter of a socket. A plurality of apertures are arranged in a predetermined decorative pattern on the board. Each aperture is sized to enable insertion of a bulb lighting portion, but presents a barrier preventing reception of a socket. The perimeter of surrounding board material provides a resilient edge which grips the bulb lighting portions. The string of lights is mounted to the board by inserting the bulb lighting portions into said apertures from the rear surface until the sockets engage the aperture perimeters. Upon illumination, the lighted string of lights provides an illuminated outline of the predetermined pattern defined by the apertures, which may be informative, as with words, or a decorative, such as a figure. The lights are easily inserted and removed for selective use in a plurality of such displays.

U.S. Pat. No. 5,531,601

Inventor: Eugene C. Amoroso

Issued: Jul. 2, 1996

A battery pack is provided for use in applications where lightweight and flexibility are desired, such as for powering an illuminated clothing article. A battery pack is provided consisting of a first and second fabrics, each having conductive traces applied upon its insides. The fabrics are sealed together forming a battery pouch area to hold and electrically connect a battery that is placed within it. Because the pack is made of fabric, and requires no connecting wires or hard case, excess weight and bulk is eliminated, resulting in a comfortable clothing article within a natural drape.

U.S. Pat. No. 5,371,657

Inventor: Brent Wiscombe

Issued: Dec. 6, 1994

An illuminated fabric article (10) includes a flexible substrate sheet (34) to which conductive ink traces (38) and lights (20) attach. The substrate sheet (34) has a low resilience so as not to press against skin (12) after it wrinkles or otherwise deforms to accommodate body (14) curves and movement. A cloth material having a thin flexible polymer film (40) applied over a woven cloth backing (42) represents one example of a suitable substrate sheet (34). A conductive ink which remains flexible after curing is applied to the substrate sheet (34) to form the conductive traces (38), which convey electrical energization to the lights (20). Each light (20) attaches to the substrate sheet (34) and to the conductive traces (38) through the use of a non-conductive adhesive patch (64) and two conductive adhesive patches (66). The lights (20) on the substrate sheet (34) are arranged to be visible from an exterior side (28) of a textile (26) so that they may be visually perceived from a distance.

U.S. Pat. No. 5,366,780

Inventor: Carmen Rapisarda

Issued: Nov. 22, 1994

An article decorated with light emitting diodes which uses stranded conductive wire. Two lengths of thin, flexible stranded conductive wire are sewn to a piece of material, and a light emitting diode has one of its conductors connected to one of the conductive wires and the other lead connected to the second wire. The wire is sewn by placing the thin, stranded conductive wire onto the bobbin of a sewing machine which then sews the conductor much in the same way it would sew a conventional thread. The result is an attractively and spectacularly decorative piece of material when the conductors are energized to light the light emitting diodes.

While these decorative lights having the conductive member affixed to a substrate material may be suitable for the purposes for which they were designed, they would not be as suitable for the purposes of the present invention, as hereinafter described.

SUMMARY OF THE PRESENT INVENTION

The present invention discloses a means for decorating using lights which are fixed to a blanket. The blanket can be of variable length and width constructed of a backing material providing means for attaching a decorative symbol, as well as means for permanently attaching a light string thereto. The light string can form a random pattern, or a recognizable symbol and can be used to highlight some decorative design within the blanket itself. The blanket can be attached to any appropriate surface using fastening means. Further the blanket can be rolled up for storage purpose which eliminates the lights and wires becoming entangled.

A primary object of the present invention is to provide a means of decorating using lights being an integral part of a decorative blanket.

Another object of the present invention is to provide a means of decorating using a blanket having lights being an integral part of said blanket wherein said blanket can be attached to any surface using various attachment means such as hook and loop, tacks, nails, screws, and hooks. Further said blanket can be detached from said fastening means and rolled up for storage.

Yet another object of the present invention is to provide a decorative blanket having integrally attached lights having electrical connection means for lighting said blanket.

Still yet another object of the present invention is to provide a decorative blanket having integrally attached lights wherein said lights can be arranged in a random pattern or a recognizable pattern such as a Christmas tree, snowman, star, candle, Santa Claus or word pattern.

Yet another object of the present invention is to provide a decorative blanket having integrally attached light wherein said blanket can be of various colors or color patterns, such as a border or symbol. Further said blanket can have a short or long napp.

Additional objects of the present invention will appear as the description proceeds.

The present invention overcomes the shortcomings of the prior art by providing a means for decorating using lights which are fixed to a blanket. Said blanket can be of variable length and width constructed of a backing material providing means for attaching a decorative symbol, as well as means for permanently attaching a light string thereto. The light string can form a random pattern, or a recognizable symbol and can be used to highlight some decorative design within the blanket itself. The blanket can be attached to any appropriate surface using fastening means. Further said blanket can be rolled up for storage purpose which eliminates the lights and wires becoming entangled.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
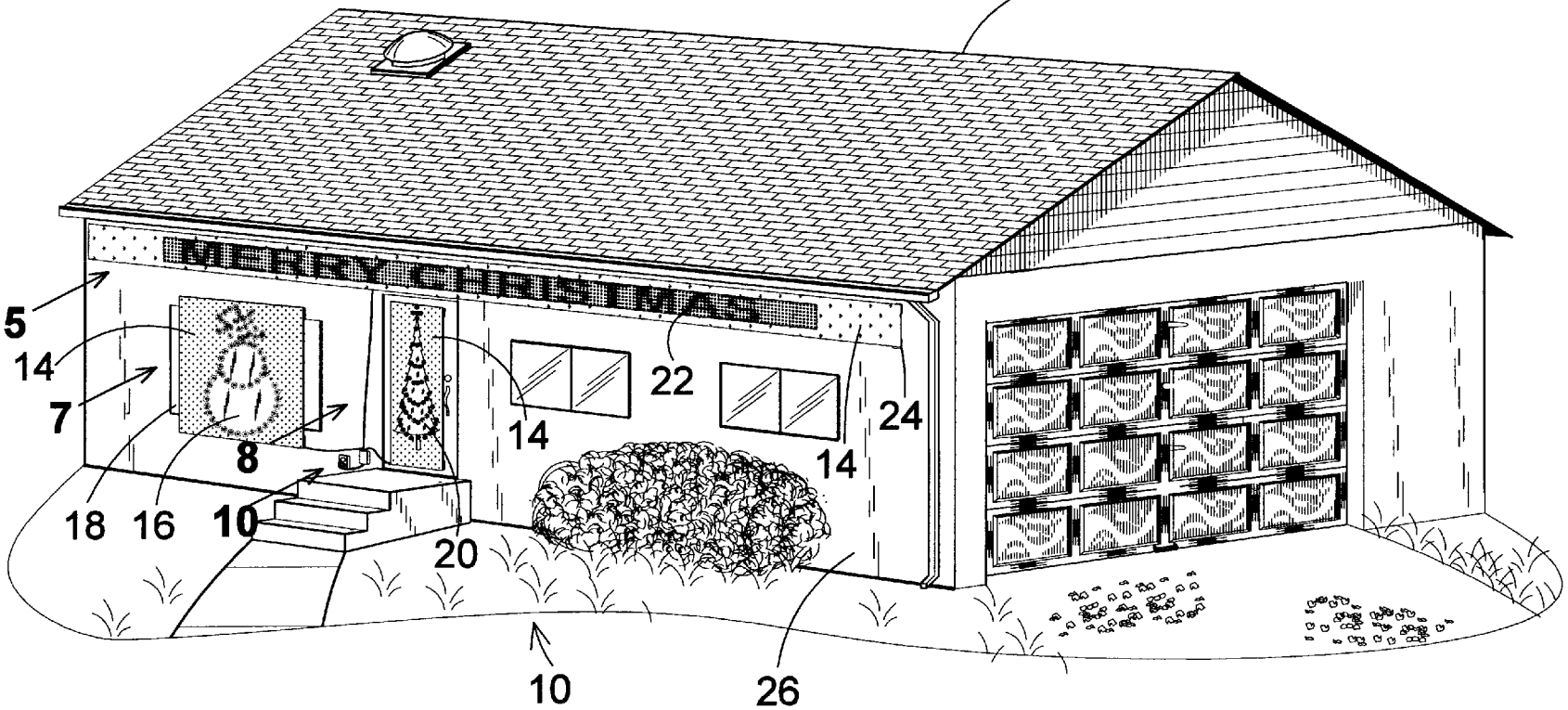
FIG. 1 is a perspective view of the present invention installed. Shown is a home having various embodiments of the present invention installed therein and thereon. Shown is a decorative blanket having a recognizable pattern on a snowman installed over a picture window. Also shown is a decorative blanket having a recognizable pattern of a Christmas tree therein and having a light pattern highlighting said blanket pattern and being an integral part of said blanket. Further shown is a decorative blanket having a light pattern in the recognizable words "Merry Christmas" being an integral part of said blanket. All of the above blankets can be detached from the fastening means and rolled up for future use without having the wires and bulbs becoming entangled.

With regard to reference numerals used, the following numbering is used throughout the drawings.

10 present invention
12 home
14 blanket
16 snowman
18 picture window
20 Christmas tree
22 recognizable words
24 blanket fastening means
26 wall of house
28 electric connection means
30 lights
32 hook and loop material
34 mounting surface
36 means for anchoring
38 substrate material
40 decorative pattern material
42 electric control box
44 power source
46 on/off switch
48 electric control means
50 bulb
52 wire
54 aperture

DESCRIPTION OF THE PREFERRED EMBODIMENT(S)

In order that the invention may be more fully understood, it will now be described, by way of example, with reference to the accompanying drawings in which FIGS. 1 through 11 illustrate the present invention being a blanket having decorative lights attached thereto.

Turning to FIG. 1, shown therein is a perspective view of the present invention 10 installed. Shown is a home 12 having various embodiments of the present invention installed therein and thereon a wall 26. Shown is a decorative blanket 14 having a recognizable pattern of a snowman 16 installed over a picture window 18. Also shown is a decorative blanket 14 having a recognizable pattern of a Christmas tree 20 therein and having a light pattern highlighting the blanket pattern and being an integral part of the blanket. Further shown is a decorative blanket 14 having a light pattern in the recognizable words "Merry Christmas" 22 being an integral part of the blanket. All of the above blankets 14 can be detached from the multiple fastening means 24 and rolled up for future use without having the wires and bulbs becoming entangled.

Figure 2:
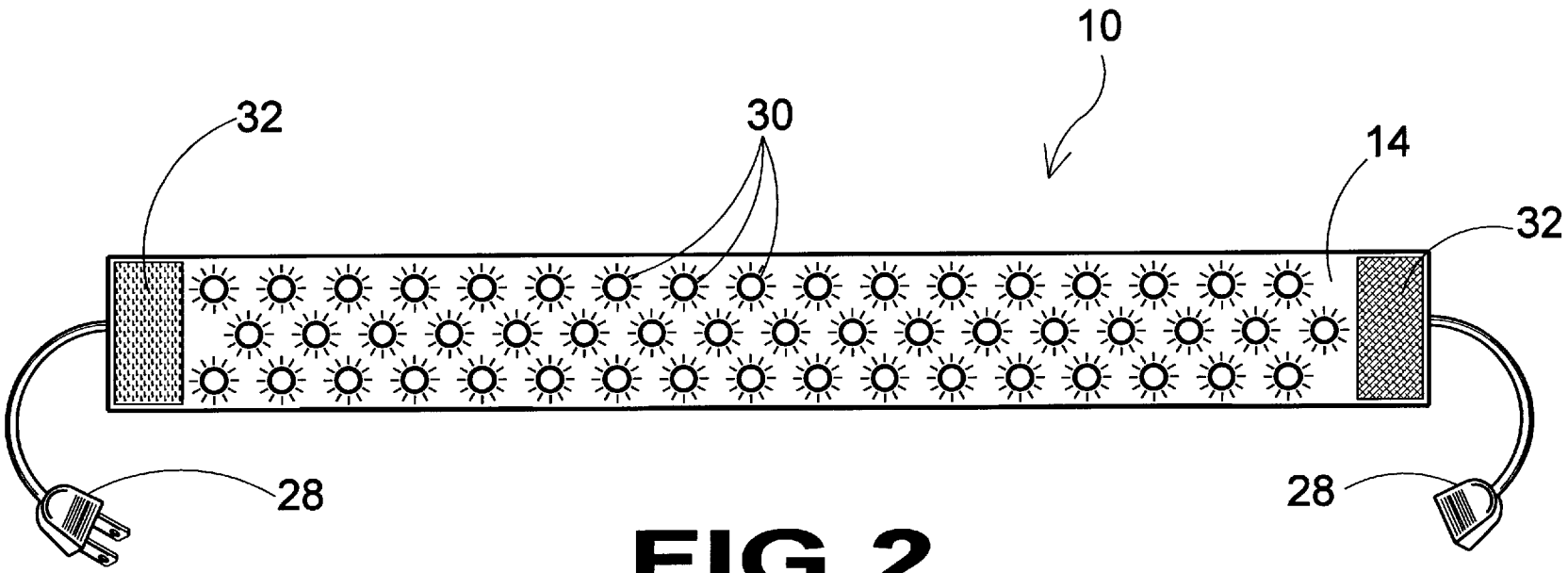
FIG. 2 is a front view of one embodiment of the present invention being a thin long blanket having electric connection means for joining one or more blanket into a uniform length of decorative material having a random light pattern affixed therein and having hook and loop material located on each distal end providing means for attaching said blanket to a surface having mating pieces of hook and loop material attached thereon.

Turning to FIG. 2, shown therein is a front view of one embodiment of the present invention 10 being a thin long blanket 14 having male and female electric connection means 28 for joining one or more blankets 14 into a uniform length of decorative material having a random light pattern 30 affixed therein and having hook and loop material 32 located on each distal end providing means for attaching the blanket to a surface having mating pieces of hook and loop material attached thereon.

Figure 3:
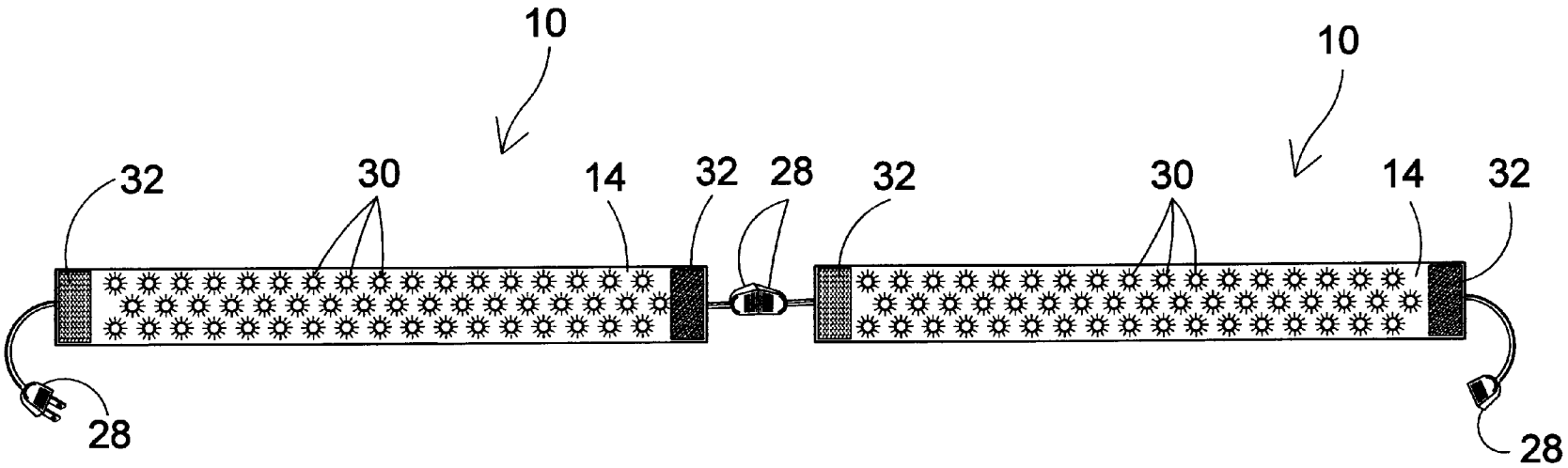
FIG. 3 is a front view of same embodiment as shown in FIG. 2 wherein a thin long blanket being electrically connected to a thin long blanket therein forming a uniform length of decorative material having a random light pattern affixed therein and having hook and loop material located on each distal end providing means for attaching said blanket to a surface having mating pieces of hook and loop material attached thereon and having electrical connection means at one distal end for energizing said blanket and electrical connection means at the other distal end for connecting additional blankets thereto.

Turning to FIG. 3, shown therein is a front view of the same embodiment of the present invention 10 as shown in FIG. 2 wherein a first thin long blanket 14 is electrically connected to a second thin long blanket 14 therein forming a uniform length of decorative material having a random light pattern 30 affixed therein and having hook and loop material 32 located on each distal end providing means for attaching the blanket to a surface having mating pieces of hook and loop material attached thereon and having electrical connection means 28 at one distal end for energizing the blanket and electrical connection means 28 at the other distal end for connecting additional blankets thereto.

Figure 4:
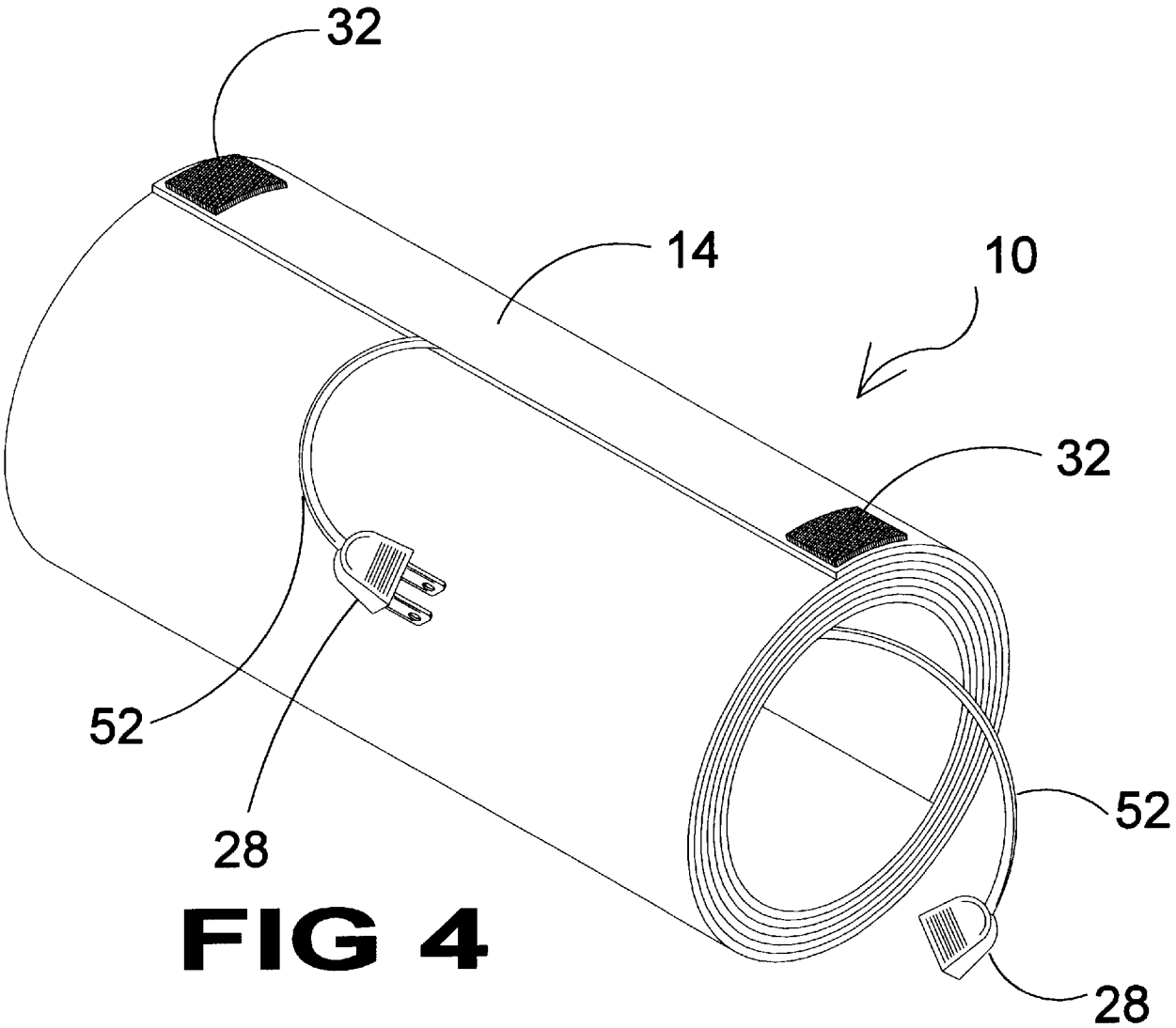
FIG. 4 is a diagrammatic view of the present invention in a rolled storage position whereby the lights and wires being an integral part of the blanket will not become entangled thereby increasing the life expectancy of the decorative item due to ease of storage and reducing frayed and twisted wires.

Turning to FIG. 4, shown therein is a diagrammatic view of the present invention 10 in a rolled storage position whereby the lights and wires 52 being an integral part of the blanket 14 will not become entangled thereby increasing the life expectancy of the decorative item due to ease of storage and reducing frayed and twisted wires 52.

Figure 5:
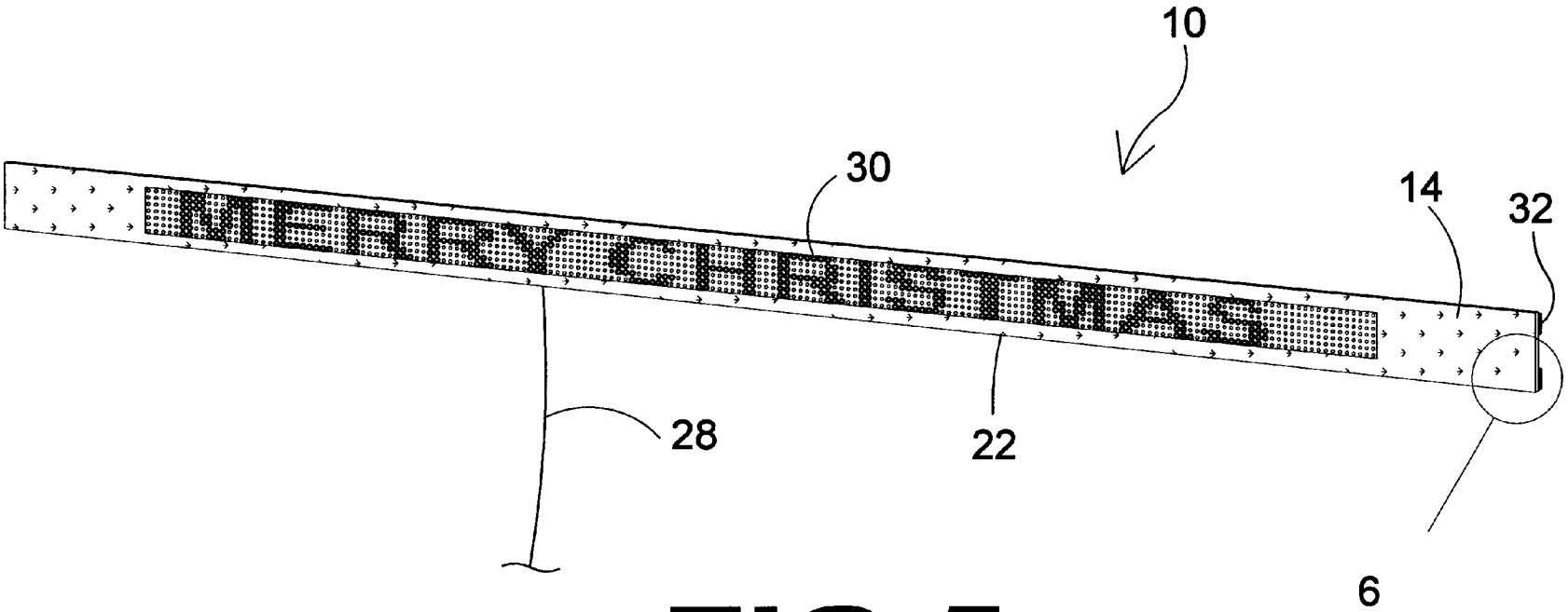
FIG. 5 is a front view of one configuration embodiment of the present invention being a thin long blanket having electric connection means for energizing the lights affixed therein. The lights are configured into a recognizable word pattern "MERRY CHRISTMAS" being an integral part of said blanket and having hook and loop material located on each distal end providing means for attaching said blanket to a surface having mating pieces of hook and loop material attached thereon.

Turning to FIG. 5, shown therein is a front view of one configuration embodiment of the present invention 10 being a thin long blanket 14 having electric connection means 28 for energizing the multiple lights 30 affixed therein. The lights are configured into a recognizable word pattern "MERRY CHRISTMAS" 22 being an integral part of the blanket and having multiple hook and loop material 32 located on each distal end providing means for attaching the blanket to a surface having mating pieces of hook and loop material 32 attached thereon.

Figure 6:
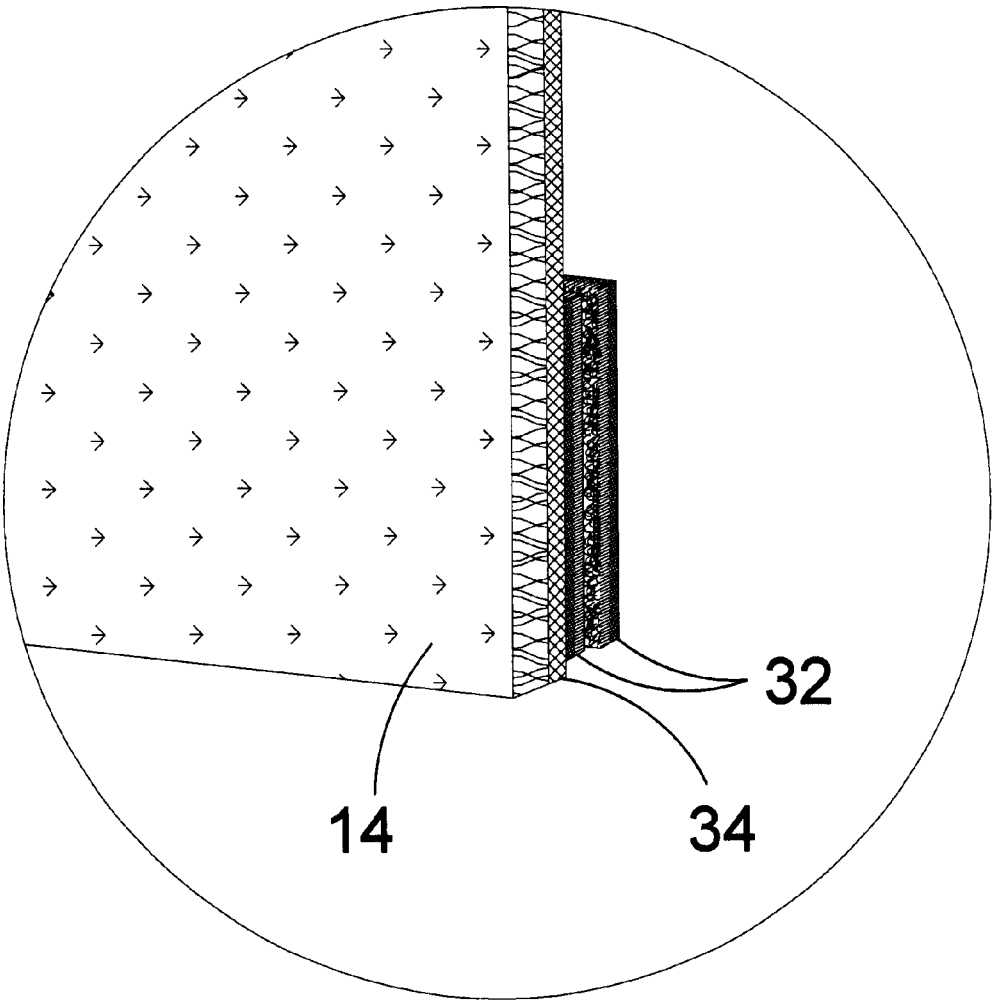
FIG. 6 is an enlarged view taken from FIG. 5 as indicated showing the blanket having one mating piece of hook and loop material affixed thereon and the mating piece of hook and loop material selectively affixed to an appropriate mounting surface for the blanket.

Turning to FIG. 6, shown therein 6 is an enlarged view taken from FIG. 5 as indicated showing the blanket 14 having one mating piece of hook and loop material 32 affixed thereon and the mating piece of hook and loop material 32 selectively affixed to an appropriate mounting surface 34 for the blanket 14.

Figure 7:
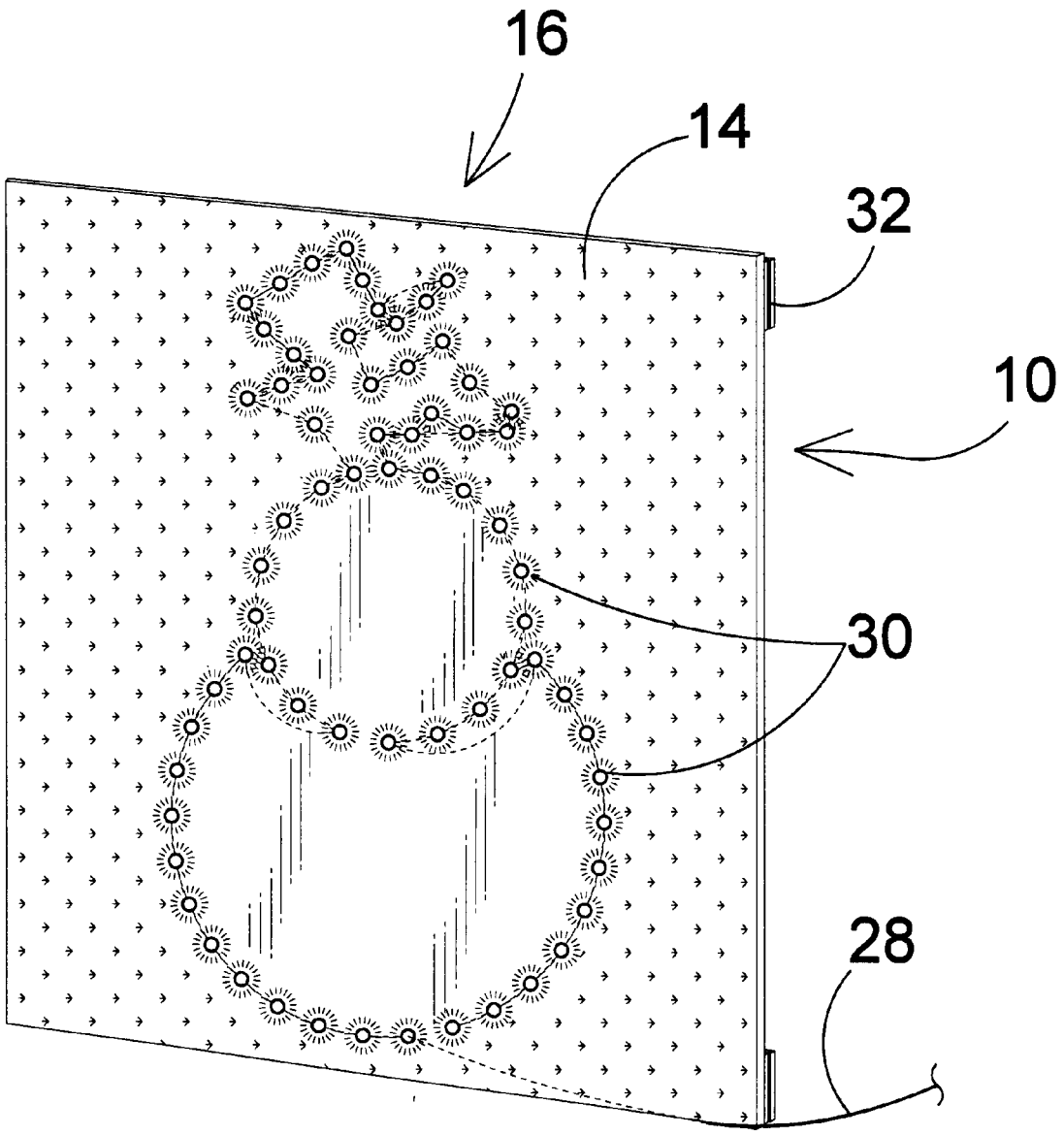
FIG. 7 is a front view of one configuration embodiment of the present invention being a recognizable figure having electric connection means for energizing the lights affixed therein. The lights are configured into the recognizable figure of a snowman which are an integral part of the decorative blanket and having hook and loop material affixed thereto providing means for attaching said blanket to a surface having mating pieces of hook and loop material attached thereon.

Turning to FIG. 7, shown therein is a front view of one configuration embodiment of the present invention 10 being a recognizable FIG. 16 having electric connection means 28 for energizing the lights 30 affixed therein. The lights 30 are configured into the recognizable figure of a snowman 16 which are an integral part of the decorative blanket 14 and having hook and loop material 32 affixed thereto providing means for attaching the blanket to a proximate surface having mating pieces of hook and loop material attached thereon.

Figure 8:
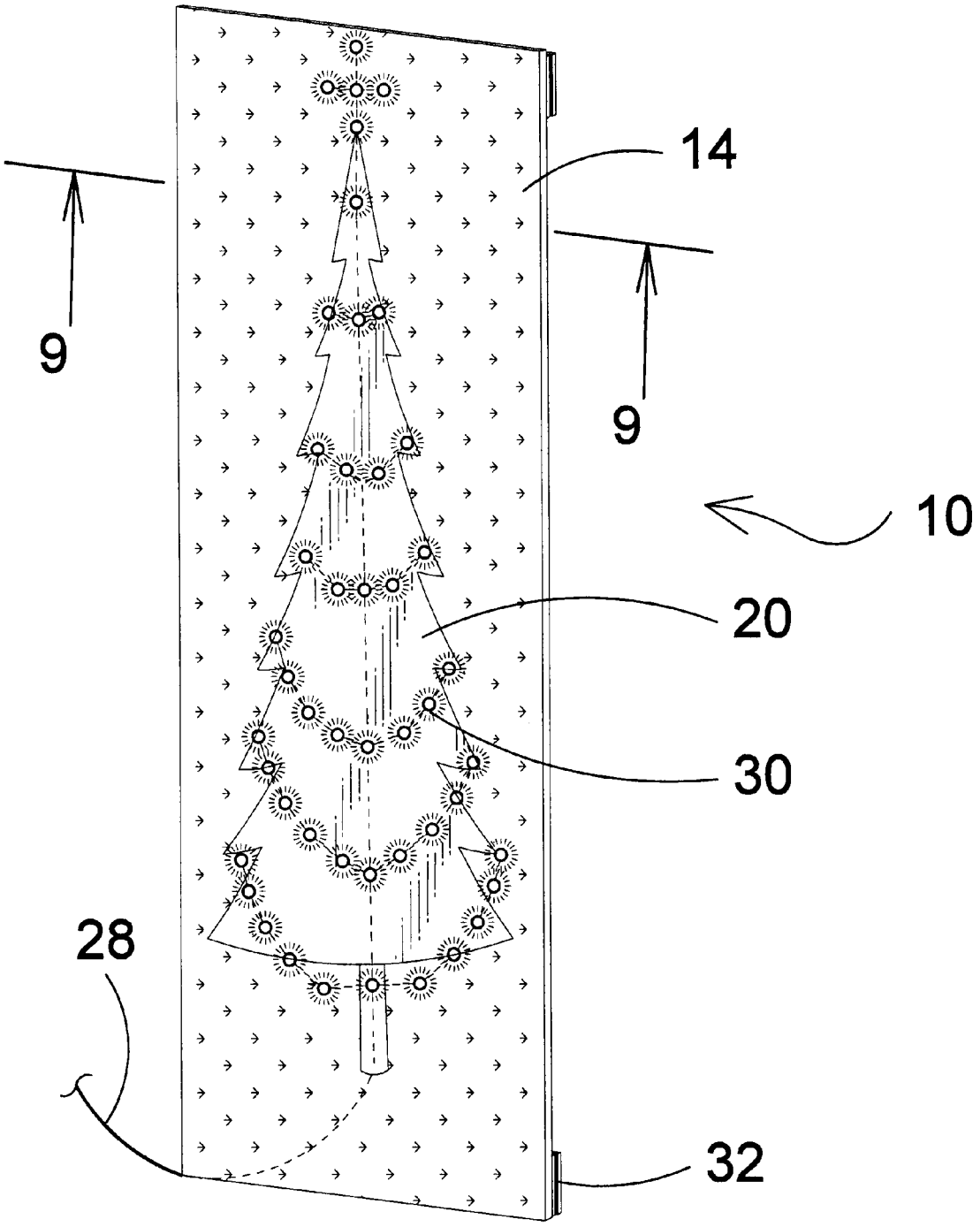
FIG. 8 is a front view of another configuration of the present invention being a recognizable figure having electric connection means for energizing the lights affixed therein. The lights are configured into the recognizable figure of a Christmas tree which forms an integral part of the decorative blanket which also has an imprint of a Christmas tree therein and said blanket having hook and loop material affixed thereto providing means for attaching said blanket to a surface having mating pieces of hook and loop material attached thereon.

Turning to FIG. 8, shown therein is a front view of another configuration of the present invention 10 being a recognizable figure 20 having electric connection means 28 for energizing the lights 30 affixed therein. The lights 30 are configured into the recognizable figure of a Christmas tree 20 which forms an integral part of the decorative blanket 14 which also has an imprint of a Christmas tree 20 therein and the blanket having hook and loop material 32 affixed thereto providing means for attaching the blanket to a surface having mating pieces of hook and loop material attached thereon.

Figure 9:
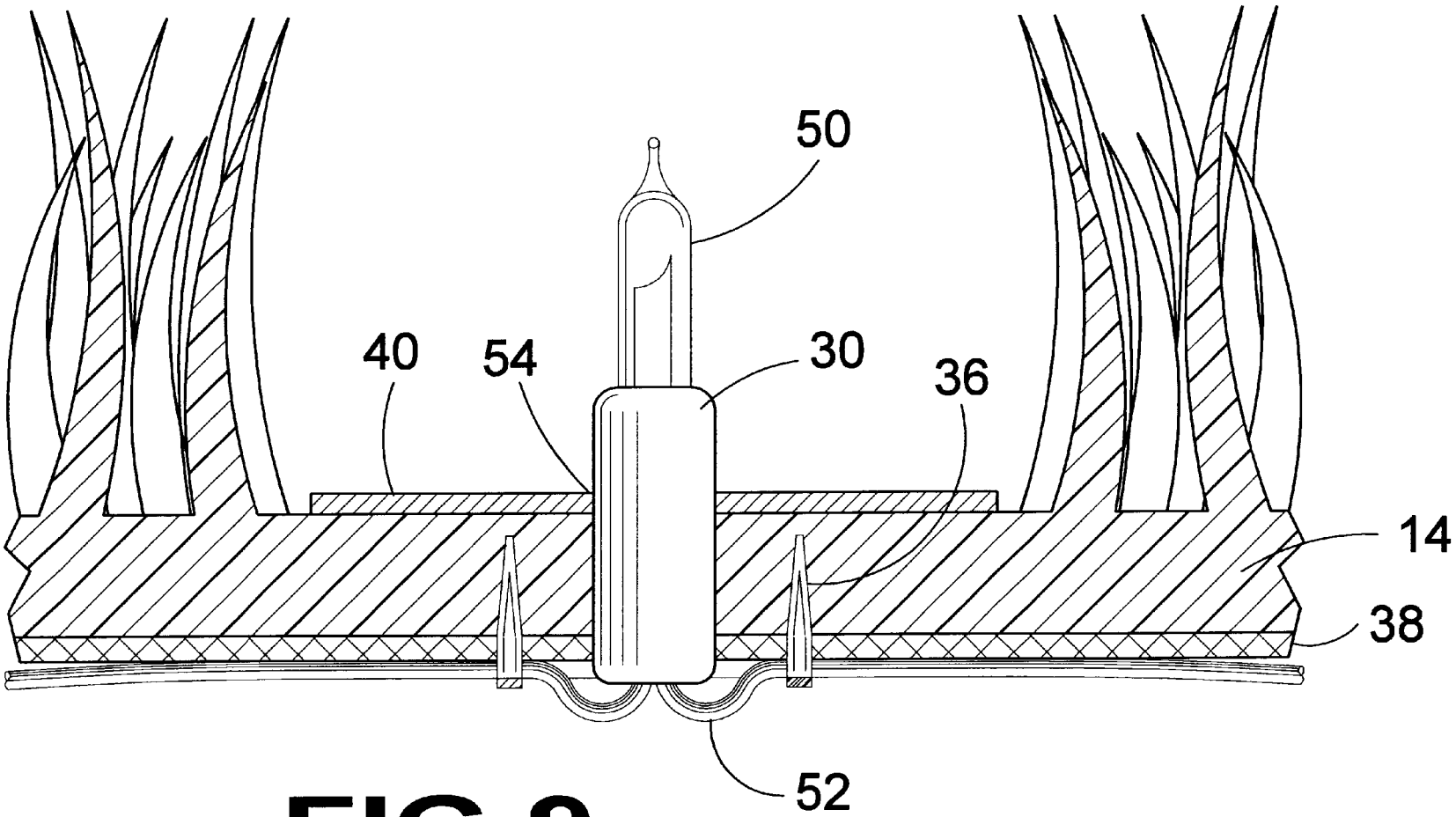
FIG. 9 is a cross sectional view, taken from FIG. 7 as indicated, showing the blanket having a substrate material which forms means for attaching a plurality of lights and having means for anchoring said lights to said substrate material. Furthermore, a decorative pattern can be affixed to the substrate material.

Turning to FIG. 9, shown therein is a cross sectional view, taken from FIG. 7 as indicated, showing the blanket 14 having a substrate material 38 which forms means for attaching a plurality of lights 30 and having multiple means for anchoring 36 the lights 30 having bulbs 50 and wires 52 to the substrate material 38. The anchor means 36 are elongated members for insertion through substrate 38 and into blanket 14. Furthermore, a decorative pattern material 40 can be affixed to the blanket 14. The decorative pattern or layer has multiple apertures 54 therein through which the lights pass.

Figure 10:
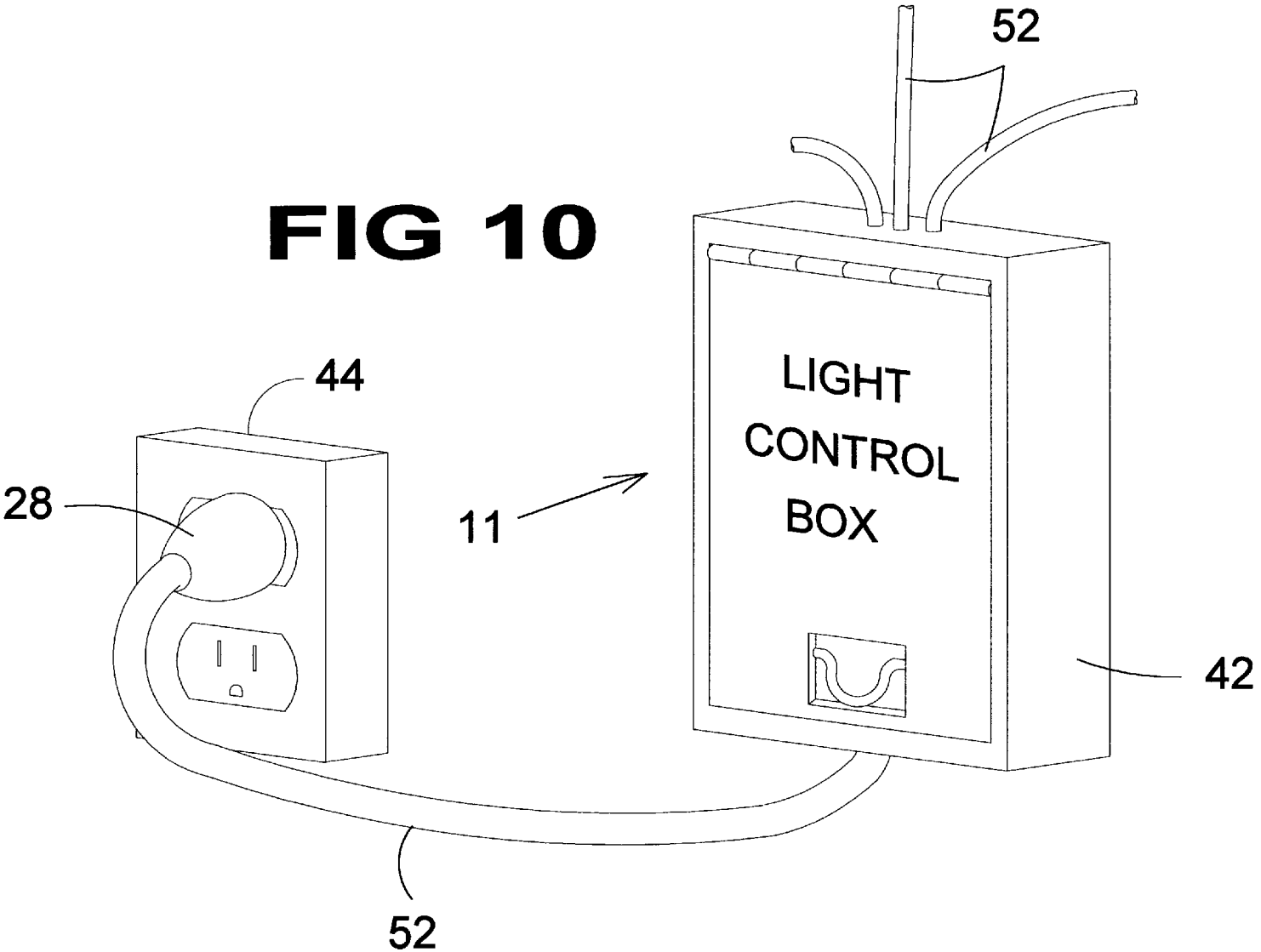
FIG. 10 is a perspective view, taken from FIG. 1 as indicated, showing the electrical control box wherein a plurality of decorative blankets can be affixed thereto and the lighting controlled therefrom.

Turning to FIG. 10, shown therein is a perspective view, taken from FIG. 1 as indicated, showing the electrical control box 42 wherein a plurality of decorative blankets (not shown) can be affixed thereto and the lighting controlled therefrom. Electric connection means 28 and wire 52 is also shown connected to a power source 44.

Figure 11:
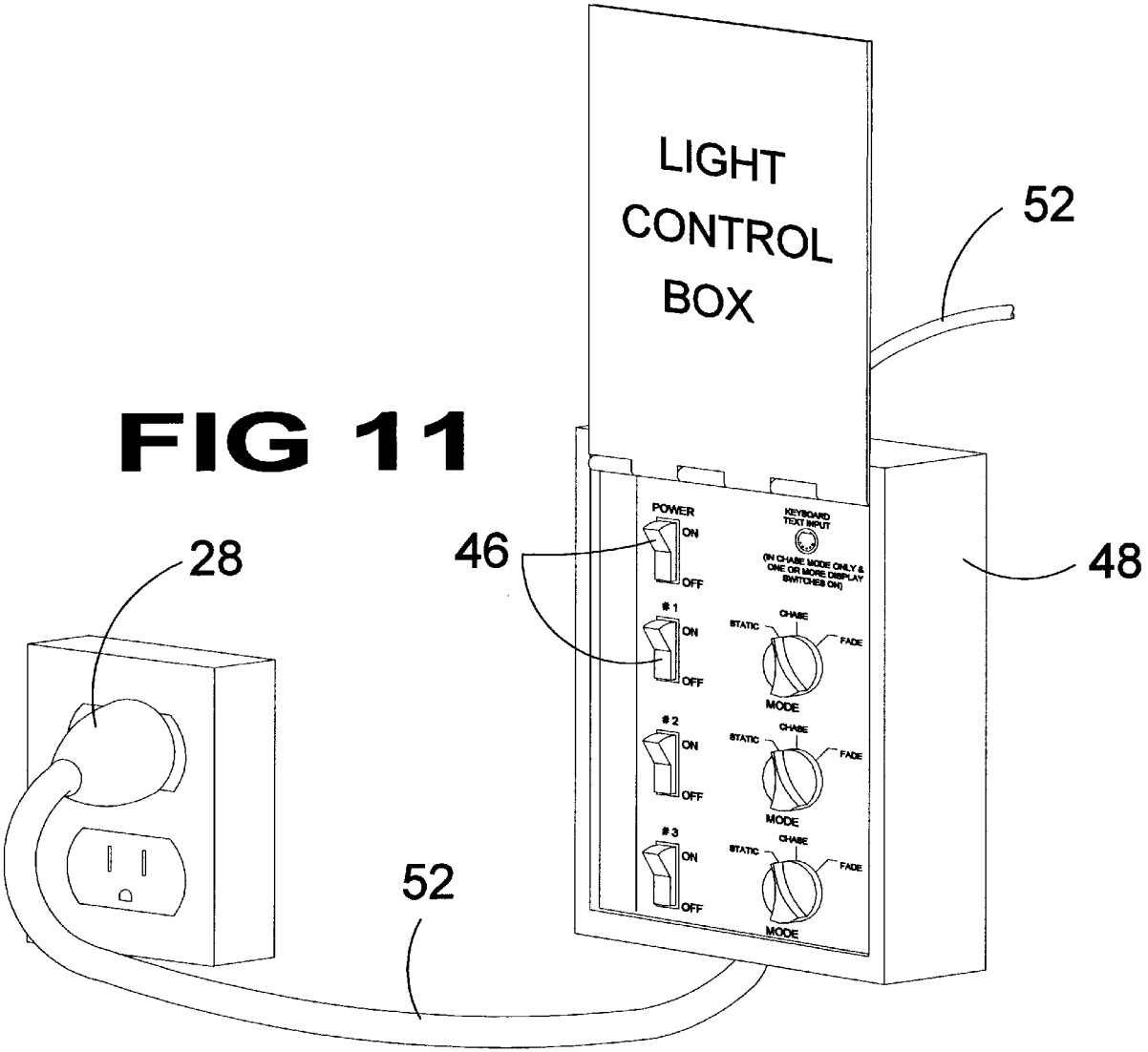
FIG. 11 is a perspective view, taken from FIG. 8 as indicated, showing electrical connection means for one or more blankets having power on and power off means. Further, said electrical control means can be placed on a timer whereby the blankets on off cycle can be varied from each other.

Turning to FIG. 11, shown therein is a perspective view, taken from FIG. 8 as indicated, showing electrical connection means 28 and wire 52 for one or more blankets (not shown) having multiple power on and power off switch means 46. Further, the electrical control means 48 can be placed on a timer whereby the blankets on/off cycle can be varied from each other.

What is claimed to be new and desired to be protected by letters patent is set forth in the appended claims:

I claim:

1. An apparatus for displaying decorative lights on a surface of a building, comprising:

a) a blanket, said blanket being generally elongated and rectangular, said blanket having a first end, a second end, a front side and a rear side;

b) a plurality of lights disposed on said front side of said blanket for a decoration;

c) a first means for attaching said blanket to the building;

d) a second means for attaching said lights to said blanket;

e) means for a decorative layer disposed on said front side of said blanket;

f) means for electrically connecting said lights;

g) a power source for said lights;

h) said second means for attaching said lights to said blanket further comprising a substrate layer disposed on said rear of said blanket; and i) means for anchoring said lights to said substrate whereby said lights are securely attached to said blanket.

2. The apparatus of claim 1, wherein said blanket is made of flexible material for being rolled.

3. The apparatus of claim 1, said first means for attaching said blanket to the building further comprises mating hook and loop material.

4. The apparatus of claim 3, wherein said hook and loop material is disposed on said first and said second ends of said blanket.

5. The apparatus of claim 4, wherein said hook and loop material is disposed on said rear side of said blanket.

6. The apparatus of claim 1, said means for anchoring further comprises elongated members for insertion through said substrate and into said blanket.

7. The apparatus of claim 1, wherein said means for a decorative layer further comprises said decorative layer having various decorative shapes.

8. The apparatus of claim 7, wherein said decorative layer is disposed on said front side of said blanket, said decorative layer having multiple apertures therein, said apertures for receiving said lights.

9. The apparatus of claim 1, further comprising multiple blankets formed from said blankets by joining said means for electrical connection together.

10. The apparatus of claim 1, further comprising means for a light control whereby said lights can be controlled.

11. The apparatus of claim 1, further comprising means for a timer, whereby the timing of said lights is controlled.

12. An apparatus for displaying decorative lights on a surface of a building, comprising:

a) a blanket, said blanket being generally elongated and rectangular, said blanket having a first end, a second end, a front side and a rear side;

b) a plurality of lights disposed on said front side of said blanket for a decoration;

c) a first means for attaching said blanket to the building;

d) a second means for attaching said lights to said blanket;

e) means for a decorative layer disposed on said front side of said blanket;

f) means for electrically connecting said lights;

g) a power source for said lights; and h) means for controlling. said lights comprising a plurality of light control switches.

13. The apparatus of claim 12, wherein said lights can be individually controlled.

* * * * *